United States Patent [19]

Schmalfeld et al.

[11] 3,962,043

[45] June 8, 1976

[54] PROCESS FOR PRODUCING FINE-GRAINED COKE BY DEGASIFICATION OF COAL

[75] Inventors: Paul Schmalfeld, Bad Homburg; Roland Rammler, Konigstein; Werner Peters, Wattensheid; Erwin Ahland, Essen; Burkhard Bock, Duisburg; Joachim Lehmann, Essen-Haarzopf, all of Germany

[73] Assignees: Metallgesellschaft Aktiengesellschaft, Frankfurt am Main; Bergwerksverband GmbH, Essen-Kray, both of Germany

[22] Filed: Nov. 26, 1974

[21] Appl. No.: 527,316

Related U.S. Application Data

[63] Continuation of Ser. No. 335,217, Feb. 23, 1974, abandoned.

[30] Foreign Application Priority Data

Feb. 23, 1972 Germany ..... 2208418

[52] U.S. Cl. ..... 201/21; 201/10; 201/31

[51] Int. Cl.[2] ..... C10B 49/10

[58] Field of Search ..... 201/10, 12, 20, 27, 201/29, 31, 21, 23, 24, 22; 208/11

[56] References Cited

UNITED STATES PATENTS

| | | | |
|---|---|---|---|
| 2,955,988 | 10/1960 | Sebantion | 201/29 |
| 3,251,751 | 5/1966 | Lindahl et al. | 201/12 |
| 3,597,347 | 8/1971 | Ellington | 201/20 |
| 3,655,518 | 4/1972 | Schmalfeld | 201/12 |
| 3,703,442 | 11/1972 | Rammler et al. | 201/12 |

FOREIGN PATENTS OR APPLICATIONS

| | | | |
|---|---|---|---|
| 1,909,263 | 9/1970 | Germany | 201/12 |

*Primary Examiner*—Curtis P. Ribando
*Attorney, Agent, or Firm*—Burgess, Dinklage & Sprung

[57] ABSTRACT

Fine-grained coke is produced by the degasification of fine-grained coal by a process which includes the following steps:

a. mixing the coal to be degasified with recirculated, heated, fine-grained coke in a mixing zone;
b. withdrawing gases and vapors produced by degasification from the top portion of an intermediate zone located below the mixing zone and subjecting same to a mechanical dust collection followed by fractional condensation;
c. recovering a dust-containing, highboiling tar fraction and recycling same to the mixing zone;
d. mixing said tar fraction with recirculated hot coke prior to mixing with coal to be degasified; and
e. completely cracking said tar fraction by matching the temperature at which the tar fraction is separated, the rate at which the tar fraction is recycled, and the temperature and quantity of the recirculated hot coke.

3 Claims, 1 Drawing Figure

PROCESS FOR PRODUCING FINE-GRAINED COKE BY DEGASIFICATION OF COAL

This is a continuation of application Ser. No. 335,217 filed Feb. 23, 1974, now abandoned.

BACKGROUND

This invention relates to a process of producing fine-grained coke by degasification of fine-grained coal. The coal to be degasified is mixed with recirculated, heated, fine-grained coke in a mixer, particularly a double-blade mixer having two shafts rotating in the same direction, the gases and vapors which are produced are withdrawn from the top portion of an intermediate bin, which is disposed below the mixer, and are subjected to a mechanical dust collection and then to fractional condensation.

When fine-grained coke is produced by a degasification of coal at elevated temperatures, recirculated fine-grained coke or hot gas is used as a heat carrier. In the latter case, the process may be carried out in an entraining gas stream or in a fluidized bed. Here, the hot gases are produced by the combustion of gas or coke and the combustion gases dilute the gases and vapors which are evolved from the coal and render the cooling of the gases and the condensation of the tars more difficult.

If fine-grained coke is used as a recirculated heat carrier, the coal gases will remain undiluted, the high calorific value of the gases will be preserved and smaller condensing means may be used.

The process of degasifying coal with the aid of coke as a recirculated heat carrier has proved highly desirable in plants which have a high production rate and serve to produce coke for sintering purposes, or as a leaning coke for coking plants, or particularly for making shaped coke bodies. The coke which is produced in the process itself is preferably used as recirculated coke. Such a process is described, for example, in DOS 1,809,874.

A problem involved in the previously described process resides in the fact that high-boiling tars produced by the condensation of the coal gases have now a low market value because they contain residual dust and differ from the tar which is produced in the conventional by-product coke-oven. They are more aliphatic and naphthenic and less aromatic. For this reason, it might be desirable to utilize the high-boiling tars in the process itself as far as possible.

In the process disclosed in DOS 1,809,874, a dry distillation of bituminous or oil-containing materials is effected by recycling a high-dust fraction of the condensed heavy oil to the dry distillation reactor and redistilling at medium temperatures. This distillation serves to remove the dust which is contained in the heavy oil produced in the first condensing stage.

DOS 1,909,263 also describes a process in which heavy oil from the first condensing stage is recycled to the dry distillation reactor. In that case, too, the heavy oil is recycled so that the dust is removed by distillation. In both of these processes, the redistillation is in most cases accompanied by an undesired secondary effect which is a slight cracking of the heavy oil.

SUMMARY

It is an object of the process according to the invention to recover more valuable products in an economically desirable manner from the dust-containing, high-boiling tar fraction, which has a low market value. This object is accomplished by matching the temperature at which the dust-containing, high-boiling tar fraction is separated, the rate at which the tar fraction is recycled, and the temperature and quantity of the recirculated hot coke so that the dust-containing, high-boiling tar fraction is completely cracked. In this way, the low-grade tar is utilized in the process itself in a productive manner.

Thus the process of the invention for producing fine-grained coke by the degasification of fine-grained coal includes the following steps:

a. mixing the coal to be degasified with recirculated, heated, fine-grained coke in a mixing zone;
b. withdrawing gases and vapors produced by degasification from the top portion of an intermediate zone located below the mixing zone and subjecting same to a mechanical dust collection followed by fractional condensation;
c. recovering a dust-containing, high-boiling tar fraction and recycling same to the mixing zone;
d. mixing said tar fraction with recirculated hot coke prior to mixing with coal to be degasified; and
e. completely cracking said tar fraction by matching the temperature at which the tar fraction is separated, the rate at which the tar fraction is recycled, and the temperature and quantity of the recirculated hot coke.

DESCRIPTION OF THE DRAWING

The accompanying drawing is a flow diagram for carrying out the process of the invention and will be more fully understood when read in light of the following description.

DESCRIPTION

Figure 1:
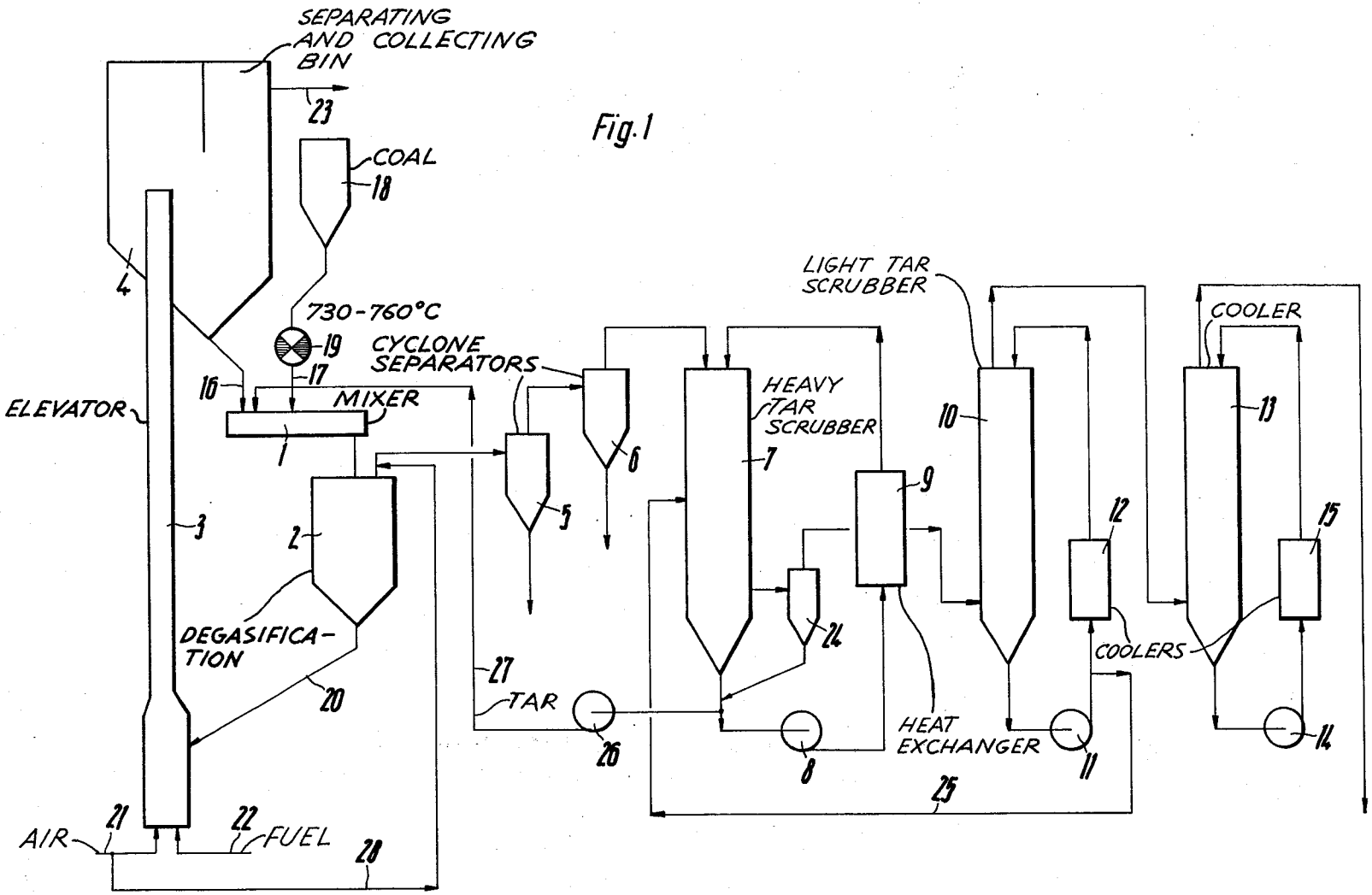

The coal to be degasified is suitably mixed with the recirculated heated coke in a mechanical mixer comprising two shafts, which rotate in the same direction, such as is described more fully in the German Pat. 932,789. Each mixing shaft is provided with two opposite, helical mixing blades, which continually clean the mixing blades of the other shaft and also the mixing chamber or zone. This mixer can be used also in the degasification of caking coal because coal and hot coke are usually mixed in a ratio of 1:5 to 1:15 by weight and each particle is quickly covered by a large number of coke particles so that there is virtually no agglomeration.

It has been found that this mixer is well suited for cracking the high-boiling tar which is produced. For this purpose the tar vapors are condensed in such a manner that the high-boiling tar is fractionally condensed first, and only in the second cooling stage is the low-boiling tar condensed together with the process water.

The heavy tar fraction is desirably injected into the mixing zone immediately after the feeding of the recirculated hot coke and as a result is spontaneously heated and cracked. Only after one-fourth or one-third of the effective length of the mixing path is the coal to be degasified fed into the mixer. Because the tar fraction is fed before the coal, the tar can be cracked at higher temperatures so that the tar is decomposed to a higher degree than if the tar were fed simultaneously with the coal or after the same.

By experience, 50% of the tar which has been fed is cracked at temperatures of about 730°–760°C. For this reason, the heavy tar fraction must be recovered and recycled to the mixer at a rate which is 200% of the rate at which heavy tar is recovered from the coal if the entire heavy tar which has been recovered is to be cracked. If higher temperatures can be used because a coke having a lower content of volatile constituents or a higher temperature is desired, the cracking will be more intense and the recycle rate of the heavy tar may be reduced from 200%, e.g., to and below 160%.

The mixing zone is usually succeeded by a zone in which the temperature of the mixture can be further equalized and an after-degasification of the newly formed coke can be effected. The zone serves also for the intermediate storage of the recirculated material which is to be elevated and heated in the succeeding elevator. The gases and vapors which are liberated in the mixer are suitably fed into the intermediate bin together with the solids stream and are withdrawn from the top part of the intermediate bin to the cooling and condensing means. They flow first through a cyclone, in which the gases and vapors are subjected to a mechanical dust collection before they flow into the tar scrubber. Instead of the provision of only one cyclone, the same may be succeeded by a second cyclone for an improved dust collection. For higher production rates, too or more parallel cyclones may be provided.

The tar scrubber is fed in the usual manner with the gases and vapors in a stream which is concurrent with the tar which is condensed therein so that the gases and tar vapors are cooled and the still entrained fine dust is bonded and removed. In a heat exchanger, the recirculated tar is cooled with cooling water, oil, air or the like to such an extent that the gases and vapors leaving the tar scrubber are at the desired temperature and the high-boiling tars have been condensed to the desired extent. The heat delivered in the heat exchanger may be used to produce useful steam. Instead of providing a heat exchanger, water may be sprayed at a metered rate into the tar scrubber so that the evaporating water cools the gases and vapors to the desired temperature. The sprayed water consists suitably of water which has been recovered in the process itself.

The dust-containing heavy tar fraction which is produced in the lower part of the tar scrubber or in an intermediate container is recycled to the scrubber by a pump and any surplus thereof is fed to the mixer. The rate at which this tar fraction is fed to the mixer is suitably so high that a desired tar level is maintained constant in the lower part of the tar scrubber or in the intermediate zone. If the recyle rate is too high, the temperature of the recycled coke must be raised.

As a result of the cracking of the recycled tar fraction, the coal gases are laden with more tar vapors so that the heaviest tar fractions may easily condense and solidify in the conduits and units from the intermediate coke bin via the cyclone to the tar scrubber. After a certain period of operation, this condensation may result in the conduits and units in deposits which are undesired and can be removed only with difficulty. This danger can by avoided by injecting combustion air at a metered rate and, if desired, in a preheated state, into the gases and vapors which leave the intermediate bin to initiate an afterburning whereby the mixture undergoes a predetermined temperature rise so that a condensation of the high-boiling tars is prevented.

As long as the gases and vapors still entrain a large K of fine-grained coke, there is only a little risk of a condensation and of a formation of undesired k The risk increases as the coke is removed. For this reason, the combustion air is suitably injected only after the cyclones or, if required, before or between the series-connected cyclones. If deposits form even in the intermediate bin under special circumstances, combustion air could be supplied also to the latter.

The process according to the invention will be explained more fully with reference to the flow scheme shown in FIG. 1. In the drawing, the means for the dry distillation of coke with the aid of recirculated fine-grained coke as a heat carrier are shown on the left and the means for condensing the gases and vapors liberated from the coal are shown on the right. The dry distillation equipment comprises a mixer 1, an intermediate bin 2, an elevator conduit 3 and a separating and collecting bin 4. The condensing means comprise two series-connected cyclones 5 and 6, a heavy tar scrubber 7 provided with a recirculating pump 8 and a heat exchanger 9, a light tar scrubber 10 provided with a recirculating pump 11 and a cooler 12, and a final cooler 13 provided with a recirculating pump 14 and a cooler 15.

The heated recirculated material which flows from the collecting bin 4 is at a temperature of, e.g., 760°C and through a conduit 16 enters the mixer 1. The mixer consists of two mixing assemblies, which rotate in the same direction and comprise each two diametrically opposite mixing blades, which clean each other and the mixing chamber.

The coal to be subjected to dry distillation is fed to the mixer 1 from an intermediate bin 18 through a conduit 17 and a metering feeder 19. Coal and coke are mixed, whereby the coal is heated to, e.g., 700°C and gases and vapors are evolved therefrom in accordance with this temperature. The mixture flows into the intermediate bin 2, in which an after-degasification of the coal takes place.

A small part of the mixture is removed from the plant by means not shown, preferably from the collecting bin 4 or from the intermediate bin 2, and is used, e.g., for making briquettes. From the intermediate bin 2, the mixture is fed through a conduit 20 into an elevator conduit 3. From below, the elevator conduit is supplied through a conduit 21 with air, which has preferably been preheated by the exhaust gases which are formed, and through a conduit 22 with fuel in the form of gas or fuel oil. The combustion of the fuel or of recirculated coke with the aid of the air results in combustion gases, which elevate the recirculated coke and at the same time heat it to a temperature of 760°C.

The heated recirculated coke is separated from the combustion gases in the collecting bin 4 and is stored in the lower part of the collecting bin and refed to the mixer 1 at a metered rate.

The exhaust gases leave the collecting bin through a conduit 23 and are subjected to a mechanical dust collection in the conventional manner in a cyclone, not shown, and subsequently utilized to preheat the air, to generate steam, and preferably to dry coal, before they are discharged into the open through a dust filter.

The gases and vapors which have been liberated from the coal which is subjected to dry distillation are subjected to a very thorough dust collection in the cyclone 5 and any succeeding second cyclone 6 and flow into the heavy tar scrubber 7, through which they flow from top to bottom concurrently with the sprayed, recirculated tar which is also supplied at the top. In this step, the gases and vapors are cooled by the recirculated tar to the temperature which is required to ensure that the recirculated tar is at the desired softening point, and the high-boiling tar constituents are condensed at the same time whereas the fine residual dust entrained by the gases and vapors is removed by the recirculated tar.

Any tar droplets still entrained by the gases and vapors leaving the heavy tar scrubber 7 are removed therefrom by the action of internal fixtures provided in the scrubber and of a succeeding cyclone 24. The gases and vapors are then scrubbed and cooled in the succeeding units 10 and 13. The scrubber 10 constitutes an intermediate cooler and serves mainly to collect high-boiling asphalt mists by scrubbing with light tar before the process water and the light tar oils are condensed in the final cooler 13. Hence, the intermediate cooler serves to prevent the formation of an emulsion in the mixture of tar oils and process water which is formed in the final cooler 13. Instead of the scrubber 10, an electrostatic precipitator can be incorporated to remove the asphalt mists. The coolers 10 and 13 are provided in the usual manner with recirculating pumps 11 and 14 and with heat exchangers 12 and 15. In the heat exchangers 9, 12 and 15, the heat can be exchanged by means of water and/or air, and these heat exchangers may also serve in part to generate steam. Instead of the provision of heat exchangers 9 and 12, process water which is to be evaporated so as to cool the gases and vapors may be sprayed into the scrubber-coolers 7 and 10, if desired.

The fractionation of the heavy tar is assisted in that light tar from the cycle of the scrubber-cooler 10 is introduced through a conduit 25 into the scrubber-cooler 7.

From the cycle of the scrubber-cooler 7, the heavy tar is fed into the mixer 1 through a conduit 27 by means of a metering pump 26. This heavy tar is spontaneously heated and cracked by the recirculated coke, which is thus cooled by, e.g., 20°–30°C. The tar is cracked to form coke, low-boiling products, and gases. Depending on the temperature of the recirculated coke, part of the tar is not decomposed and remains high-boiling. This part is only evaporated and will then be found as a condensate in the heavy tar scrubber 7.

The recycling of the heavy tar results in a higher concentration of high-boiling hydrocarbons in the gases and vapors which leave the mixer 1 and the intermediate bin 2. This involves a higher risk of a condensation and deposition of the highest-boiling tar constituents in the units and conduits. To avoid this danger, air at a metered rate is suitably injected through a conduit 28 at the point where the gases and vapors are discharged from the intermediate bin 2 to the cyclone 5. This air causes a combustion of part of the gases and vapors so that these are heated as desired by, e.g., 50° to 100°C or the like. As a result, the highest-boiling tars cannot condense. Air may also be injected at a suitable location in the intermediate bin 2, if required, although a higher air rate will be required in this case because recirculated coke will then also have to be heated.

The risk of a deposition of condensed tar on the surfaces of the units and conduits is higher when the coke dust has been removed from the gases and vapors. If deposits are formed only behind the cyclones, an unnecessary heating of the dust which has been collected from the coke in the cyclones 5 and 6 can be avoided in that the air is injected only behind the cyclone 5 or also behind the cyclone 6.

Experience has shown that during a dry distillation of caking coal, the space around the mixing shafts which is not cleaned by the mixing blades in the mixer is gradually filled with deposits of coke from coal and from tar. For this reason it is not necessary to provide around the mixing shafts a special space for the discharge of gases because such space would be gradually filled up anyway. It will be more useful to select mixing shafts which are sufficiently large in diameter so that the gases and tar vapors which are evolved can flow through the mixing chamber to the intermediate bin at a velocity and with a pressure loss which are not too high.

The invention will be further described in the following illustrative example with reference to the drawing.

EXAMPLE

About 150 metric tons per hour of fine-grained coke, serving as a recirculated heat carrier, are passed through mixer 1, intermediate bin 2, elevator conduit 3 and collecting bin 4. About 13 metric tons per hour of predried coal are fed into mixer 1 where they are mixed with the hot recirculated coke of about 760° C temperature. Thus the temperature of the mixture is about 700° C. At this temperature the coal degasifies and produces per hour about 8,000 kg of coke, about 1,560 kg of high-boiling tar containing about 100 kg of dust, about 180 kg of low-boiling tar and about 2,000 kg of gases and uncondensed light oils; additionally water is distilled off. The high-boiling tar is recirculated to the beginning of the mixer, there meeting at first with the hot coke of 760° C, and undergoes a thermal cracking. From 1,560 kg of tar this cracking produces about 350 kg of coke containing about 100 kg of dust, about 220 kg of dust-free low-boiling tar, about 172 kg of gases and uncondensed light oils, together with 38 kg of water. About 780 kg of the high-boiling tar are vaporized and recondensed in scrubber-cooler 7. As a result about 50% of the tar recycled into mixer 1 is cracked.

For satisfactory operation it is obviously necessary that the quantity of recycled tar remains constant and does not rise above a predetermined limit. Thus, if the quantity of recycled tar would increase, tar would have to be withdrawn from the system. The quantity of recycled tar can be kept constant only by cracking the recycled tar at the same rate that tar is newly formed from coal. This means that when 50% of the recycled tar is cracked in the mixer and 1,560 kg per hour of high-boiling tar are newly formed, the quantity of recycled high-boiling tar must be adjusted to 200% of the quantity of newly formed tar, i.e., 3,120 kg/h.

It will be appreciated that the instant specification and examples are set forth by way of illustration and not limitation and that various modifications and changes may be made without departing from the spirit and scope of the present invention.

What is claimed is:

1. Process for producing fine-grained coke by degasification of fine-grained coal which comprises:

a. mixing coal to be degasified with recirculated, heated, fine-grained coke in a mixing zone; b. feeding the mixture from (a) to a degasification zone located below said mixing zone; pulses c. withdrawing gases and vapors produced by degasification in step (b) from the top portion of said degasifiction zone, subjecting said gases and vapors to a mechanical dust collection followed by fractional condensation, and recovering a dust-containing, high-boiling tar fraction;

d. feeding said tar fraction back to said mixing zone at a rate which is about twice the rate at which new high-boiling tar is formed by degasification in said degasification zone; and e. mixing said tar fraction with said recirculated hot coke in said mixing zone, prior to mixing with said coal to be degasified, at temperatures in the range of 730°–760°C thereby cracking and eliminating about half of the quantity of said tar fraction fed back to said mixing zone in step (d) thus keeping the quantity of high-boiling tar constant in the process.

2. Process of claim 1 wherein air is mixed with the gases and vapors withdrawn in step (c) thereby effecting a partial combustion and a superheating of said gases and vapors.

3. Process of claim 1 wherein air is mixed with said gases and vapors withdrawn in step (c) after the mechanical dust collection thereby effecting a partial combustion and a superheating of said gases and vapors.

* * * * *